US010288283B2

(12) United States Patent
Skachkov et al.

(10) Patent No.: US 10,288,283 B2
(45) Date of Patent: May 14, 2019

(54) MULTIPHASE BURNER

(71) Applicant: Schlumberger Technology Corporation, Sugar Land, TX (US)

(72) Inventors: Roman Alexandrovich Skachkov, Novosibirsk (RU); Pavel Andreevich Golikov, St. Petersburgh (RU); Christian Menger, Recke (DE); Vladimir Konstantinovich Khan, Novosibirsk (RU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 865 days.

(21) Appl. No.: 14/436,485

(22) PCT Filed: Oct. 17, 2012

(86) PCT No.: PCT/RU2012/000837

§ 371 (c)(1),
(2) Date: Apr. 17, 2015

(87) PCT Pub. No.: WO2014/062076

PCT Pub. Date: Apr. 24, 2014

(65) Prior Publication Data

US 2015/0330626 A1 Nov. 19, 2015

(51) Int. Cl.
*F23G 7/08* (2006.01)
*F23D 14/22* (2006.01)

(52) U.S. Cl.
CPC ..... *F23G 7/085* (2013.01); *F23D 14/22* (2013.01); *F23G 7/08* (2013.01); *F23G 2900/70* (2013.01)

(58) Field of Classification Search
CPC ..... F23G 7/08; F23G 7/085; F23D 14/22
(Continued)

(56) References Cited

U.S. PATENT DOCUMENTS 4,679,733 A 7/1987 Lipp
5,823,759 A 10/1998 Swithenbank
(Continued)

FOREIGN PATENT DOCUMENTS

EP 2385299 A2 11/2011
RU 2315237 C1 1/2008
(Continued)

OTHER PUBLICATIONS

International Search Report and Written Opinion dated Aug. 15, 2013, for PCT/RU2012/000837, filed on Oct. 17, 2012.
(Continued)

*Primary Examiner* — Avinash A Savani
*Assistant Examiner* — Aaron H Heyamoto
(74) *Attorney, Agent, or Firm* — Cameron R. Sneddon

(57) ABSTRACT

A multiphase burner for flaring gaseous/liquid combustible mixtures is disclosed. The burner may include a hollow base with an inlet for receiving the combustible gas/liquid mixture as well as a distal end that may be coupled to or that forms a nozzle cap. The nozzle cap may form as first outlet. The base may be coupled to a central body and a hollow bushing that encircles at least part of the central body. The base may form a mouth disposed between the inlet and the central body. The mouth may be in communication with a first passage that extends from the mouth to the first outlet and between the bushing and the distal end of the base. The mouth may be in communication with a second passage that extends from the mouth to the second outlet and between the bushing and central body.

18 Claims, 3 Drawing Sheets

(58) Field of Classification Search
USPC ..... 431/5
See application file for complete search history.

(56) References Cited

U.S. PATENT DOCUMENTS

| | | | | |
|---|---|---|---|---|
| 5,934,555 | A | 8/1999 | Dobbeling et al. | |
| 6,003,798 | A | 12/1999 | Kim | |
| 6,978,942 | B2 | 12/2005 | Murdoch | |
| 7,967,600 | B2 | 6/2011 | Hong et al. | |
| 7,993,131 | B2 | 8/2011 | Douglas | |
| 2002/0066268 | A1* | 6/2002 | Papamoschou | F02K 1/36 60/262 |
| 2005/0120927 | A1* | 6/2005 | Okazaki | F23D 1/00 110/261 |
| 2008/0209729 | A1* | 9/2008 | Tursky | B01D 53/9454 29/890 |

FOREIGN PATENT DOCUMENTS

| | | | |
|---|---|---|---|
| RU | 2315238 | C1 * | 1/2008 |
| RU | 2455562 | C1 | 7/2011 |
| SU | 570405 | A1 | 9/1977 |

OTHER PUBLICATIONS

International Preliminary Report on Patentability issued in the related PCT Application PCT/RU2012/000837, dated Apr. 30, 2015 (6 pages).

Examination Report issued in the related GC Examination GC2013-25593, dated Jun. 19, 2017 (3 pages).

Lefebvre et al.,Gas Turbine Combustion: Alternative Fuels and Emissions, Third Edition, CRC Press, 2008, chapter 2, p. 45-54.

* cited by examiner

MULTIPHASE BURNER

BACKGROUND

Flare apparatuses in the form of a flare stack and one or more burners or ground-level flares in earthen pits are known and are used for burning combustible gases. Flare apparatuses are commonly used for disposing of flammable waste gases or other flammable gas streams in oil and gas production and refining, chemical plants, pipelines, liquefied petroleum and natural gas terminals, etc.

For example, oil and gas wells are tested by burning or "flaring" well fluid at the surface. The well fluid may be comprised of hydrocarbon gases, such as natural gas, oil and formation water. The term "wet gas" is commonly used for such well fluids. One problem associated with flaring of wet gas on offshore platforms is the radiant heat produced by flaring the wet gas and the effect of the radiant heat on the personnel and equipment disposed on the platform. Other problems include smoke formation and hydrocarbon fallout.

Specifically, it is generally desirable that the wet gas be flared without producing smoke and typically such smokeless or substantially smokeless flaring is mandated by regulatory agencies. Fallout of unburned hydrocarbons can occur when the wet gas being flared does not burn completely or cleanly. The resulting smoke and unburned hydrocarbon fallout may create both environmental and safety concerns as the unburned hydrocarbons may be disposed in liquid droplets that ultimately fall out of the ambient air onto the surface of the platform or the ocean.

Smokeless and fallout-free flaring of wet gas can be achieved by supplying additional air (i.e., air-assisted flaring) or steam (i.e., steam-assisted flaring) to the burner, which can result in a complete oxidation of the wet gas. However, at high flow rates of the wet gas, providing the optimal supply of air or steam for premixing upstream of the burner through pumps or blowers can become impractical or impossible, especially on offshore platforms or remotely located land-based drilling rigs. In contrast, when a highly turbulent jet of combustible wet gas is created in an open-air burner that does not require premixing, most of the requisite combustion air can be obtained from the ambient atmosphere near the flame. The design of such open-air burners is based on a maximum entrainment of ambient air into a high-pressure jet emitted through the burner head.

Further, the use of open-air burners for the combustion of wet gas would require spraying or atomizing of the liquid component that is carried by the input flow. The atomizing would be followed by mixing of the gas and atomized liquid with ambient air, which would create a mix suitable for clean flaring. While known atomizing nozzles are efficient if high-pressure gas and liquid flow are supplied through separate ducts, the wet gas for gas flaring at a rig site is a mixture of gas and liquid delivered to a flare apparatus together and in time-variable and unpredictable proportions. As a result, existing atomization nozzles cannot be used for oil and gas flaring without a gas/liquid separator, which is impractical for most offshore platforms and many land based well sites. Further, existing atomization nozzles are noisy, which adversely affects the safety and working environment of an offshore platform or a land-based well site.

Thus, wet gas burners are required that significantly reduce heat radiation and pollutants in the form of smoke and fallout that result from incomplete combustion, that can operate under a wide range of input pressures and that can operate with a reduced noise level.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A multiphase burner is disclosed that is capable of flaring wet gas or a gas stream that includes a liquid fraction without producing smoke, particulates or hydrocarbon fallout. The disclosed multiphase burner may include a hollow base that has a central axis and a proximal end that may serve as an inlet for receiving a combustable fluid, such as wet gas. The base may further include a distal end that may be coupled to a nozzle cap. The nozzle cap may form a first outlet that is concentric with the central axis of the base. The base may also be coupled coaxially to a central body. Further, the base may also be coaxially coupled to a hollow holder that encircles at least part of the central body. The holder may be coupled to a hollow bushing that may also encircle at least part of the central body. The bushing may form a second outlet that encircles the central axis and that is disposed axially within the first outlet. The base may form a mouth disposed along the central axis in between the inlet and the central body. The mouth may be in communication with two passages for splitting the flow of wet gas through the burner. The first passage may extend from the mouth to the first outlet and between the holder and the distal end of the base. The second passage may extend from the mouth to the second outlet and between the holder and the central body.

BRIEF DESCRIPTION OF THE DRAWINGS

For a more complete understanding of the disclosed methods and apparatuses, reference should be made to the embodiment illustrated in greater detail on the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

Disclosed herein is a flaring apparatus in the form of a multiphase burner that provides clean and smokeless combustion of a waste gas effluent or a waste gas-liquid fuel mixture (i.e., "wet gas") at high inlet pressures through fine atomization of the liquid component of the wet gas, intensive mixing with ambient air and self-sustaining ignition. The disclosed multiphase burner also may provide improved burning efficiency at decreased noise levels and improved mechanical durability and reliability.

In a typical well testing operation, a gas flare is used to burn the wet gas exiting a well test separator. The wet gas typically includes a fraction of liquid that remains in the gas flow and needs to be combusted. The liquid typically includes water and oil but some formations produce wet gas with a liquid fraction that includes water without oil, oil without water, or both at the same time. As disclosed herein, smoke-free and fallout-free flaring of the wet gas is possible even with a high fraction of liquid.

Figure 1:
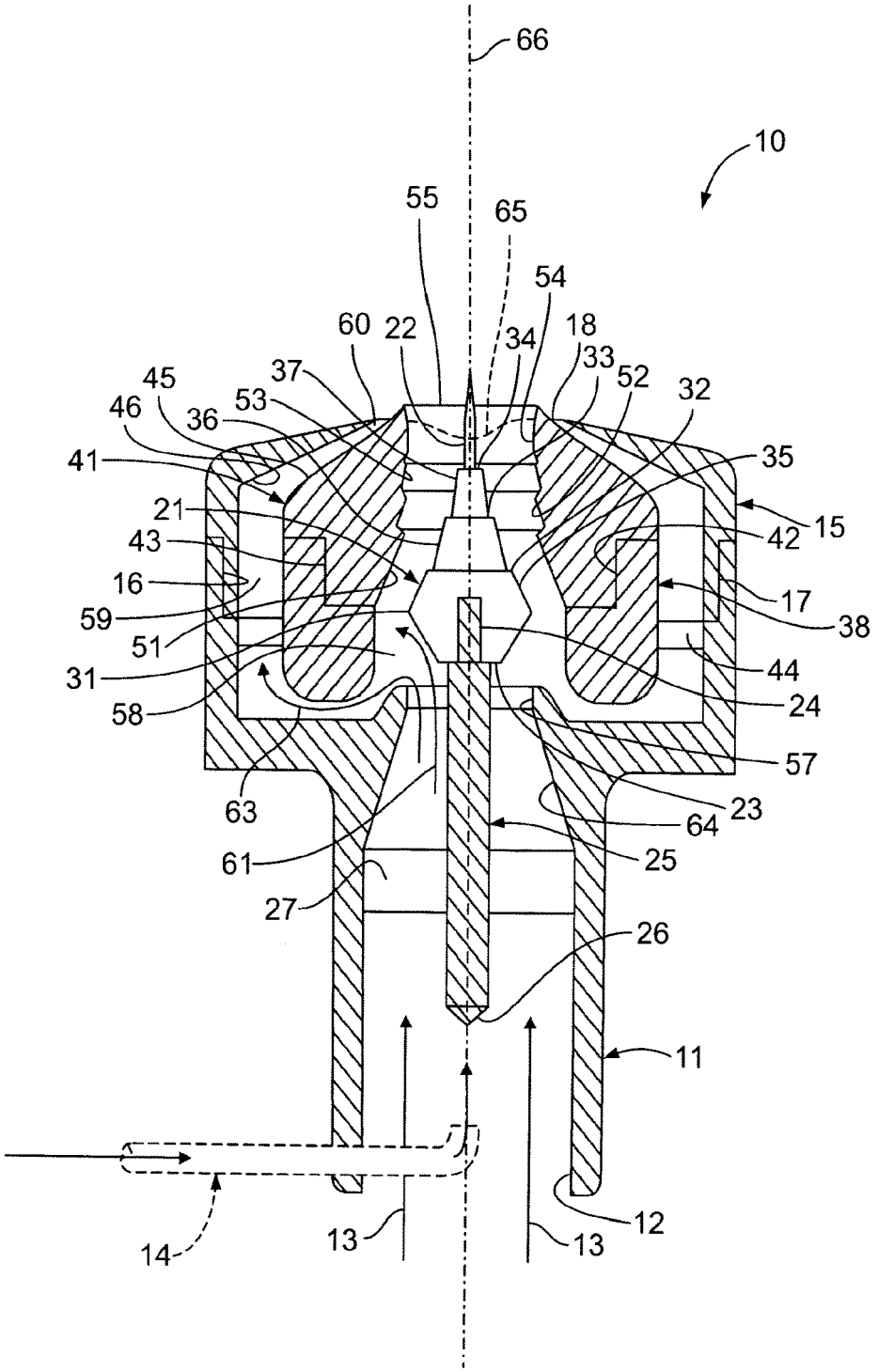
FIG. 1 is a cross-sectional view of a disclosed multiphase burner with an optional liquid input that is separate from the main gas/wet gas input.
Figure 2:
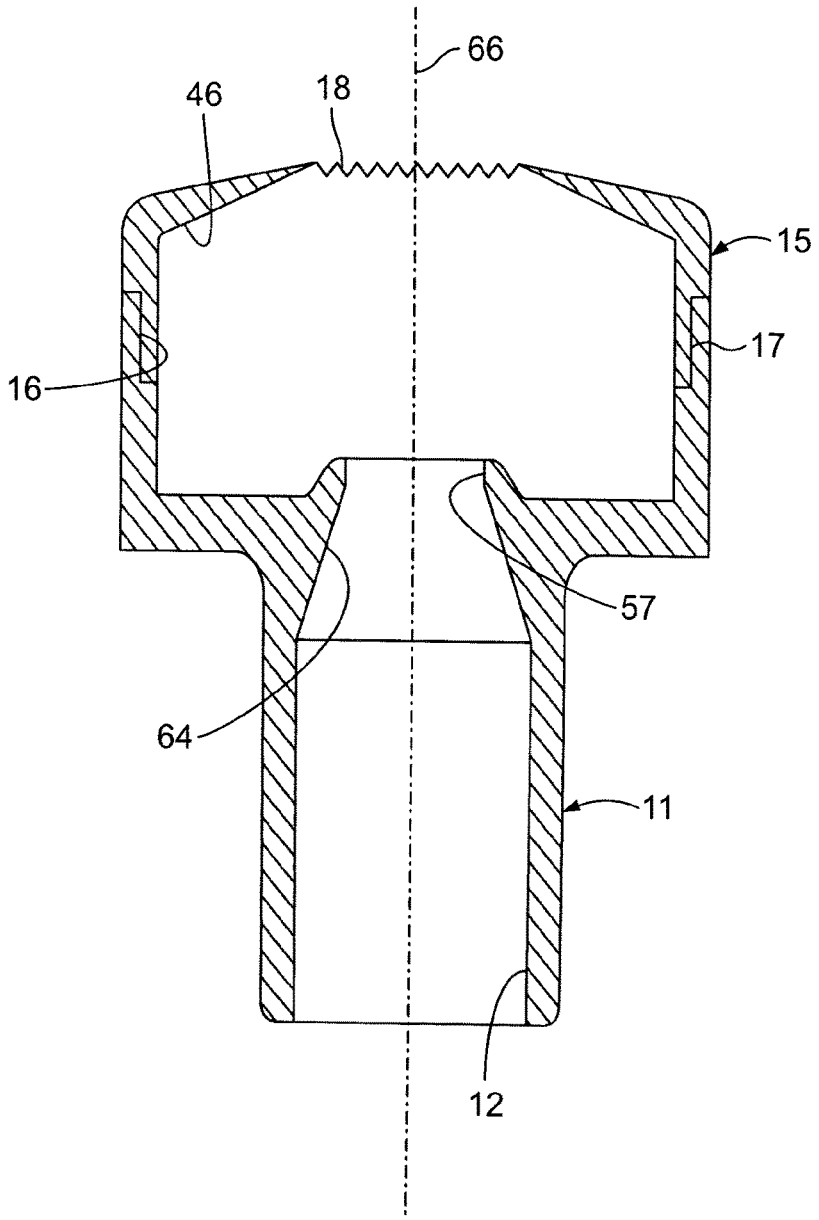
FIG. 2 is a cross-sectional view showing the base and nozzle cap with the serrated outlet of the multiphase burner of FIG. 1.

FIG. 1 shows a cross-sectional view of a disclosed multiphase burner 10. The burner 10 may include a base 11 that may define an inlet 12 for wet gas flow as indicated by the arrows 13. Also shown in FIG. 1 is an optional liquid inlet 14 that is shown in phantom. As shown in FIGS. 1 and 2, the base 11 may be coupled to a nozzle cap 15 indirectly or directly. For example, the base 11 may be threadably connected to the nozzle cap 15 by equipping the base 11 with a threaded distal end 16 and by equipping the nozzle cap 15 with a threaded proximal end 17. The base 11 and nozzle cap 15 may also form an integral structure. The nozzle cap 15 may also include an outlet 18 that may be serrated as shown in FIG. 2 for enhancing the atomization of the liquid fraction of the waste gas as discussed below.

Figure 3:
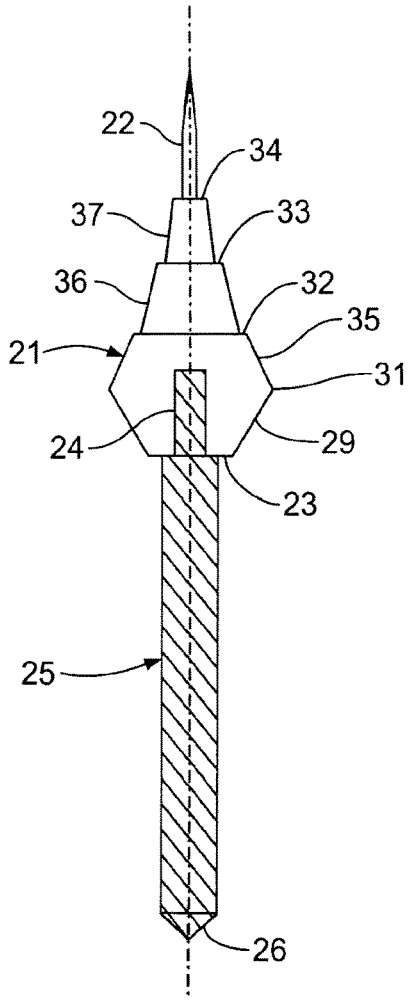
FIG. 3 is a sectional view of the central body and support of the multiphase burner of FIG. 1.

As shown in FIGS. 1 and 3, the burner 10 may also include a central body 21. The central body 21 may have a conical or tapered distal end 22 and a proximal end 23 that may be coupled to a distal end 24 of a support 25. The support 25 may also include a tapered proximal end 26 for limiting interference with the incoming wet gas flow 13. The support 25 may be coupled to the base 11 using a strut 27 as shown in FIG. 1. The proximal end 23 of the central body 21 may be connected to a frustoconical section 29 that expands radially outwardly before terminating at a circumferential bulge 31, which may be the widest portion of the central body 21 that may be followed in the proximal direction by a series of increasingly smaller steps 32, 33, 34 disposed between increasingly smaller frustoconical sections 35, 36, 37 that extend radially inwardly before being followed by the tapered conical distal end 22.

Figure 4:
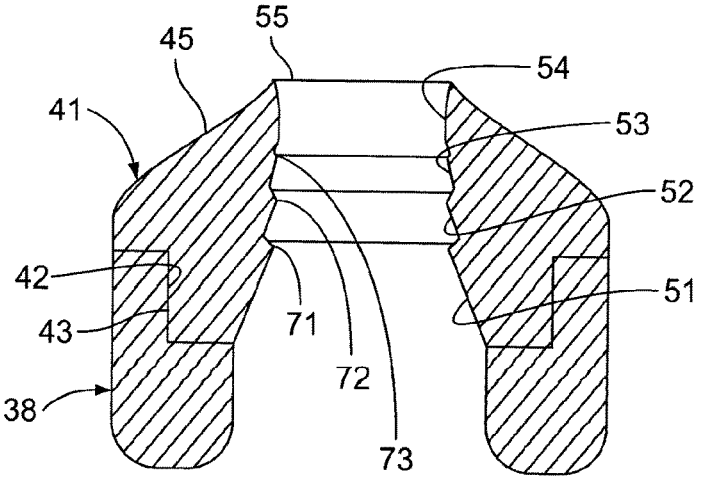
FIG. 4 is a sectional view of the holder and nozzle cap of the multiphase burner of FIG. 1.

In addition to supporting the central body 21 and support 25, the base 11 may also support a holder 38 by way of the strut 44. The holder 38 may be integrally connected to or coupled directly or indirectly to a bushing 41. As shown in FIGS. 1 and 4, the holder 38 may include a threaded distal end 42 and the bushing 41 may include a threaded proximal end 43 for purposes of detachably connecting the holder 38 to the bushing 41. As will be apparent to those skilled in the art, the holder 38 and the bushing 41 may also be unitary in structure. As shown in FIG. 1, another strut 44 may be used to couple the holder 38 and/or bushing 41 to the base 11 and/or the nozzle cap 15.

As shown in FIGS. 1 and 4, the bushing 41 may include a tapered outer surface 45 that follows the tapered inner surface 46 of the nozzle cap 15. Further, the bushing 41 may also include an inner surface with a plurality of radially inwardly tapered segments 51, 52, 53 with inwardly extending ridges 71, 71, 73 disposed after each segment 51, 52, 53. The segment 53 may be followed by a distal segment 54 that terminates at an outlet 55. The inwardly tapered segments 51, 52, 53 of the bushing 41 may follow the contour of the frustoconical sections 35, 36, 37 of the central body 21 but in a slightly offset relationship as shown in FIG. 1.

The base 11 may also form a mouth 57 through which the support 25 passes. The strut 27 may be used to support the central body 21 and the support 25 in the axial position shown in FIG. 1. The mouth 57 may be in communication with a central passage 58 as well as an outer passage 59 as the burner 10 may split the flow 13 into the dual flows 61, 63 as shown in FIG. 1.

The burner 10 may operate in the following manner. The inlet wet gas flow 13 for flaring may be supplied though pipelines (not shown) to the base 11. The inlet wet gas flow 13 may be a complex and unsteady combination different phases: gas flow (mainly methane); droplets of oil and water carried by high-velocity gas flow; liquid film on the inlet 12 (not shown), which may be transformed into liquid slugs; and, as a minor component, flow of particulates (e.g., sand from the formation and other debris from metal pipelines). This multiphase wet gas inlet flow 13 passes through the narrow mouth 57. At the sharp edge of mouth 57, the inlet flow 13 may be divided into two flows 61 and 63 as shown in FIG. 1.

The flow 61 may include gas carrying liquid droplets and liquid jets, which develop as a result of detachment of liquid film from the base 11 at or near the tapered surface 64 and/or the mouth 57. The gas, liquid droplets and liquid jets move through the central passage 58 between the central body 21 and the holder 38/bushing 41. Due to the converging inner surface 64 of the base 11 in the vicinity of the mouth 57 (see FIGS. 1 and 2), the liquid film on the converging inner surface 64 and the mouth 57 may detach and undergo a partial dispersion into the high-velocity flow 61 before being partially captured on various outer surfaces 35, 36, 37 of the central body 21 and/or on the various inner segments 51, 52, 53 or ridges 71, 72, 73 of the bushing 41. Specifically, the high-venolcity flow 61 through the central passage 58 may cause liquid film to be scattered onto the central body 21 and the bushing 41, which results in additional atomizing of liquid into small droplets as the flow 61 is ejected out through the outlet 55.

In contrast, the flow 63 includes gas and liquid droplets and passes through the outer passage 59 as shown. The flow 63 exits the burner 10 through the nozzle cap outlet 18, which as shown in FIG. 2, is serrated, which further enhances the atomization of any liquid droplets in the flow 63.

The design of the burner 10 and its dual passage flows 61, 63 may provide an improved dispersion of big liquid droplets and liquid films. Specifically, big liquid droplets and any liquid films from the flow 61 may be dispersed into smaller droplets inside the burner 10 and between the central body 21 and holder 38/bushing 41. Further, another atomization of the flow 61 may take places downstream the sonic transition cross-section shown in phantom at 65 in FIG. 1. At the sonic transition cross-section 65, substantial gradients in the gas flow velocity upstream of the sonic transition cross-section 65 and downstream of the sonic transition cross-section 65/outlet 55 may induce atomization of any liquid present into a smaller spray or mist. The burner 10 may also help to keep the products of atomization close to the central axis 66 of the burner 10, which may ensure that atomized droplets will be delivered to the combustion zone and avoid fallout trajectories.

For a high-pressure gas-liquid flow (when the absolute pressure at the inlet 12 of the base 11 exceeds about 0.2 MPa), transition of a flow through the narrowing central passage 58 may result in the sonic transition critical section 65 at a narrow point of the central passage 58. The critical section 65 may be defined as a section where the gas flow at a given temperature reaches the sonic level. As an example, an expected location for critical cross-section 65 in the gas flow 61 through the central passage 58 is shown just upstream of the outlet 55 in FIG. 1.

The smooth-shaped mouth 57 in combination with the control body 21 splits inlet gas-liquid flow 13 into two parts 61, 63 as shown in FIG. 1. One part 61 of the inlet flow 13 proceeds through the central passage 58 as described above. The other part 63 of inlet flow 13 includes gas with small droplets and undergoes a turn around the mouth 57 before being directed to the outer passage 59 defined by the base 11/nozzle cap 15 on the outside and the holder 38/bushing 41 on the inside. The outer passage 59 exits the burner through the annular orifice 60 (FIG. 1) defined by the outlet 18 of the nozzle cap 15 and the outlet 55 of the bushing 41. The outlet 18 may be equipped with sharp tabs or serrations as shown in FIG. 2.

The serrations on the outlet 18 of the nozzle cap 15 may produce turbulisation of the exit flow and may improve aeration of the final mixture at the outlets 18, 55 of the burner 10 while suppressing jet noise while the flow 63 is ejected from the outer passage 59. The small size of the serrations may also act to disperse the liquid film (if a film has survived up to outlet 18) into small droplets that continue their flight in the near the central axis 66.

The dual flows 61, 63 produced by the burner 10 may result in only a minor part of liquid (in the form of small droplets) that is dragged by the deviated gas flow 63 into the outer passage 59. Therefore, the gas flow 63 passing through outer passage 59 may have much lower liquid content than the flow 61 through the central passage 58.

The smallest cross-sectional area for the central passage 58 may be at or near the outlet 55 and may also be in close proximity to the smallest cross-sectional area for the outer passage 59, which is at the outlet 18 and which may also be small enough to generate sonic velocities for the flow 63. Any surviving liquid droplets in the flow 63 may be dispersed into a fine mist along the central axis 66 as such droplets exit the outlet 18. Specifically, at the outlet 18 of the nozzle cap 15, the flow from the outer passage 59 ejects near the serrated outlet 18. The serrations on the outlet 18 facilitate dispersion of any liquid film present in the flow 63 along the axis 66, better mixing of gas with ambient air, and a reduction in the jet noise level.

As a result of gas-liquid flow splitting into two flows 61, 63 and dispersion of liquid droplets inside the burner 10, the exit flow may consist of a core flow with a high concentration of liquid droplets (spray flow) and a turbulised sheath-shaped flow with a low concentration of entrained droplets. Mixed with ambient air and entrained by a highly turbulised jet flow, the mixture of combustible gas, liquid droplets, and air becomes a mixture that may be ignited for clean and smokeless combustion of wet gas with a high amount of entrained liquid. The mass fraction of liquid in the inlet flow can be up to 30% or more. However, the described gas burner device also operates as effective burner for fluids with low liquid content (dry gas) as well.

The smallest cross-sectional area for the central passage 58 is about equal to the smallest cross-sectional area for the outer passage 59. However, the proportions between the minimal cross-sectional areas for two passages 58 and 59 can vary by 30-50% depending on the fluid composition and inlet pressure in the base 11. The serrations on the outlet 18 may be triangular-shaped with the height in the range from about 2 to about 6 mm. However, as will be apparent to those skilled in the art, other geometries and sizes can be chosen for liquid film atomization, effective gas-air mixing, and jet noise reduction. The bushing 41 and central body 21 may have axisymmetric shapes for defining the central passage 58. Since a minor fraction of solid particulate (sand) can be found in the burner inlet flow 13 and high-speed solid particles create an abrasive impact on target surfaces (sand-jetting), the bushing 41 and central body 21 may be fabricated from a wear-resistant alloy.

In field conditions, due to high velocities of fluid flow and intensive heat radiation from the flame, the nozzle cap 15 and bushing 41 may degrade to a point of failure before other parts of burner 10. Therefore, the nozzle cap 15 and bushing 41 may be replaced in a quick process performed on-site due to the use of threaded distal surfaces 42, 43, 16, 17. Specifically, the nozzle cap 15 may be detached from the base 11 and the bushing 41 may be detached from the holder 38 without disturbing the central body 21. Durability of the burner 10 is achieved in part by using abrasion-resistant materials for the bushing 41 and nozzle cap 15 and providing the removable design for the bushing 41 and nozzle cap 15.

In general, the disclosed high-pressure multiphase burner 10 with dual passages 58, 59 may be used to improve the dispersion of liquid components of wet gas and provide improved flaring over other burners known in the art.

The wet gas inlet pressure may be greater than 1 barg. For input pressures above 1 barg, the critical section 65 at the outlet 55 and the critical section at the annular orifice defined by the outlet 18 and the outer surface 45 of the bushing 41 are formed inside the central passage 58 and outer passage 59 respectively, and this facilitates dispersion liquid components into a fine spray of gas-liquid fuel at the burner outlets 55, 18.

Although the disclosed burner 10 is described as multiphase burner, it must be appreciated that the burner 10 as described herein can be used for combustion of dry combustible gas ('dry gas") without any changes in design.

The gas-liquid flow 13, 14 that is directed through the two passages 58, 59 within the burner 10 may pass through corresponding critical sections (shock waves) if the input pressure exceeds about 2 barg. Fluid mechanics may describe this situation as under-expanded flow. As the exit gas-liquid flow comes out from the outlets 55, 18 to surrounding air, shock waves may be developed, which creates zones of high and low pressure. At a stable input flow rate, the shock waves remain at certain distances from the nozzle outlets 55, 18. These zones may be a place of additional atomization of liquid droplets. As the flow (gas jet with atomized fuel) keeps expanding, the axial velocity of the jet becomes close to the flame propagation speed, so self-stabilization of flare flame takes place.

The disclosed multiphase burner 10 may be used in many industries, including those where a separate liquid feed 14 is required. The liquid component (or liquid component with suspended solid particles like particles of micronized coal) may be fed through the inlet 14 into the base 11 and the gas (vapour) component of the feed may be supplied through the inlet 12 as shown in FIG. 1. The liquid component may be carried by the gas flow and may be dispersed into smaller droplets in the central passage 58 before these liquid droplets may be dispersed into fine droplets at the outlet 55 due to the high-speed gas flow passing through the central passage 58. The burner 10 may operate both at low pressures (<1 barg) and at higher pressures (>1 brag) when shock waves develop within the passages 58 and 59.

While only certain embodiments have been set forth, alternatives and modifications will be apparent from the above description to those skilled in the art. These and other alternatives are considered equivalents and within the spirit and scope of this disclosure and the appended claims.

What is claimed:

1. A multiphase burner comprising:

a hollow base having a central axis and including an inlet for receiving a combustible fluid, the base further including a distal end that is coupled to a nozzle cap, the nozzle cap forming a first outlet that encircles the central axis, the base further being coupled coaxially to a central body that includes a proximal end disposed distally from the mouth and within the holder and a tapered distal end that extends through the second outlet, the proximal end of the central body being connected to a first frustoconical section that expands radially outward to a circumferential bulge, the circumferential bulge being connected to a second frustoconical section that extends radially inwardly before being connected to a third frustoconical section that extends radially inwardly before being coupled to the tapered distal end, the base also being coaxially coupled to a hollow holder that encircles at least part of the central body, the holder being coupled to a hollow bushing that encircles at least part of the central body, the bushing forming a second outlet that encircles the central axis and that is disposed within the first outlet, the base forming a mouth disposed along the central axis and between the inlet and the central body, the mouth in communication with a first passage that extends from the mouth to the first outlet and between the holder and the distal end of the base, the mouth in communication with a second passage that extends from the mouth to the second outlet and between the holder and the central body.

2. The burner of claim 1 wherein the base and nozzle cap are connected.

3. The burner of claim 1 wherein the base is tubular.

4. The burner of claim 1 wherein the holder and bushing are integrally connected.

5. The burner of claim 1 wherein the holder and bushing are threadably connected.

6. The burner of claim 1 wherein the central body includes a proximal end that includes a circumferential bulge that extends radially outwards towards, but spaced apart from the holder, the central body also including a tapered distal end that extends axially through the second outlet.

7. The burner of claim 1 further including a fourth frustoconical section disposed between the third frustoconical section and the tapered distal end, the fourth frustoconical section extending radially inwardly before being connected to the tapered distal end.

8. The burner of claim 1 wherein the bushing includes an inner surface that includes a plurality of radially inwardly extending segments before terminating at the second outlet.

9. The burner of claim 1 wherein the bushing includes an inner surface that includes a plurality of segments that extend radially inwardly towards the central body but that are spaced apart from the central body before terminating at the second outlet.

10. The burner of claim 6 wherein the proximal end of the central body is coupled to a support, the support being coupled to the base and including a shaft having a distal end connected to the proximal end of the central body and a proximal end disposed in the inlet of the base.

11. The burner of claim 10 wherein the shaft passes through the mouth.

12. The burner of claim 1 wherein the nozzle cap may be removed from the base and the bushing may be removed from the holder without disturbing the central body.

13. The burner of claim 1 wherein first outlet is serrated.

14. A method for flaring a wet gas flow, the method comprising:

delivering the wet gas flow to an inlet of a hollow base, the base including a mouth that is in communication with a first annular passage and a second annular passage that is concentrically disposed within the first annular passage, the first annular passage being defined by a nozzle cap and a hollow bushing, the nozzle cap being coupled to the base, the hollow bushing being coupled to the base and concentrically within the nozzle cap, the nozzle cap forming a first outlet, the bushing forming a second outlet, the second annular passage being defined by the bushing and a central body disposed axially within the bushing, dividing the wet gas flow into a first flow that passes through the first annular passage and a second flow that passes through the second annular passage, compressing the first flow in the first passage and accelerating the first flow to sonic speed by forcing the first flow between the nozzle cap and the bushing before the first flow is ejected out through the first outlet, compressing the second flow in the second passage and accelerating the second flow to sonic velocity by forcing the second flow between the bushing and the central body before the second flow is ejected out through the second outlet, atomizing fluid in the second flow at the second outlet by engaging the second flow with ridges disposed on an inner surface of the bushing before the second flow is accelerated to sonic speed at the second outlet, and igniting the first and second flows downstream of the first and second outlets.

15. The method of claim 14 further including atomizing fluid in the first flow at the first outlet by engaging the first flow with serrations that encircle the first outlet.

16. The method of claim 14 wherein the first flow includes less liquid than the second flow.

17. A multiphase burner for flaring wet gas, the burner comprising:

a hollow base having a central axis and including an inlet for receiving a flow of wet gas, the base further including a distal end that is coupled to a nozzle cap, the nozzle cap forming a first outlet with a serrated rim that encircles the central axis, the base further being coupled to a central body that is disposed along the central axis, the base also being coaxially coupled to a hollow holder that encircles at least part of the central body, the holder being coupled to a hollow bushing that encircles at least part of the central body, the bushing forming a second outlet that encircles the central axis and at least part of the central body and that is disposed concentrically within the first outlet, the base forming a mouth disposed along the central axis and between the inlet and the central body, the mouth in communication with a first passage that extends from the mouth to the first outlet and between both the holder and bushing and the distal end of the base, the mouth in communication with a second passage that extends from the mouth to the second outlet and between both the holder and bushing and the central body, the bushing having an inner surface and the central body having an outer surface, the inner surface of the bushing including a plurality of ridges, the outer surface of the central body including a plurality of steps.

18. The burner of claim 1 wherein the nozzle cap may be removed from the base and the bushing may be removed from the holder without disturbing the central body.

* * * * *